US011408637B2

(12) United States Patent
Roopnarine

(10) Patent No.: US 11,408,637 B2
(45) Date of Patent: Aug. 9, 2022

(54) SEALING COVER FOR AIR CONDITIONERS

(71) Applicant: Roopnarine, New York, NY (US)

(72) Inventor: Roopnarine, New York, NY (US)

( * ) Notice: Subject to any disclaimer, the term of this patent is extended or adjusted under 35 U.S.C. 154(b) by 425 days.

(21) Appl. No.: 16/583,248

(22) Filed: Sep. 25, 2019

(65) Prior Publication Data

US 2020/0096224 A1 Mar. 26, 2020

Related U.S. Application Data

(60) Provisional application No. 62/736,512, filed on Sep. 26, 2018.

(51) Int. Cl.

| | |
|---|---|
| ***F24F 13/20*** | (2006.01) |
| ***F24F 1/027*** | (2019.01) |
| ***F24F 1/0057*** | (2019.01) |
| *F24F 13/24* | (2006.01) |

(52) U.S. Cl.

CPC ..... *F24F 13/20* (2013.01); *F24F 1/0057* (2019.02); *F24F 1/027* (2013.01); *F24F 13/24* (2013.01); *F24F 2013/205* (2013.01); *F24F 2221/36* (2013.01)

(58) Field of Classification Search

CPC ..... F24F 13/20; F24F 13/24; F24F 1/0057; F24F 1/027; F24F 1/03; F24F 1/031; F24F 2013/205

See application file for complete search history.

(56) References Cited

U.S. PATENT DOCUMENTS

| | | | | | |
|---|---|---|---|---|---|
| 2,711,769 | A * | 6/1955 | Katcher | F24F 13/20 | 62/262 |
| 2,992,668 | A * | 7/1961 | Collard | F24F 13/20 | 5/497 |
| 4,068,428 | A * | 1/1978 | Peterson, III | E06B 3/28 | 160/354 |
| 4,202,389 | A * | 5/1980 | Ewald | F24F 13/20 | 150/165 |
| 4,325,229 | A * | 4/1982 | DeZurik | F24F 13/20 | 62/262 |
| 4,332,114 | A * | 6/1982 | Goebel | F24F 13/20 | 182/47 |
| 4,389,827 | A * | 6/1983 | Van Valkenburg | F24F 13/20 | 52/309.4 |
| 4,625,784 | A * | 12/1986 | Boroson | F24F 13/20 | 206/320 |

(Continued)

*Primary Examiner* — Emmanuel E Duke
(74) *Attorney, Agent, or Firm* — Peter Kramer

(57) ABSTRACT

An improved cover for covering and sealing an air conditioning unit that is otherwise exposed to the room in which it is installed. The cover is easily mounted to or removed from the wall or surface from which the air conditioner projects and in the preferred embodiment is made from a fabric that is also easily cleaned and stored when not in use. Around the periphery of the cover's open end is a flange to which one element of a separable fastening system is affixed; the other element of the fastening system may have an integral adhesive backing and can be easily installed on the wall or surface. Mating the separable elements of the fastening system seals the enveloped air conditioner and its sleeve from air, noise and bug or insect infiltration. Other alternative embodiments and fastening methods are disclosed for an improved cover that is easy to install, remove, clean and store.

7 Claims, 4 Drawing Sheets

(56) References Cited

U.S. PATENT DOCUMENTS

| | | | | | |
|---|---|---|---|---|---|
| 4,759,194 | A * | 7/1988 | Shapiro | F24F 13/00 | 62/262 |
| 4,788,805 | A * | 12/1988 | Shaw | F24F 13/00 | 52/395 |
| 5,125,197 | A * | 6/1992 | Fuchs | F24F 13/20 | 62/262 |
| 5,341,860 | A * | 8/1994 | Klein | F24F 13/24 | 62/262 |
| 6,061,981 | A * | 5/2000 | Nieves | F24F 13/20 | 62/262 |
| 7,328,589 | B2 * | 2/2008 | Boone | F24F 13/082 | 62/262 |
| 9,347,217 | B2 | 5/2016 | Feur | | |
| 2009/0145153 | A1 * | 6/2009 | Moynihan | F24F 1/62 | 62/259.1 |
| 2015/0168009 | A1 * | 6/2015 | Otway | F24F 1/027 | 150/165 |

* cited by examiner

SEALING COVER FOR AIR CONDITIONERS

TECHNICAL FIELD

This disclosure describes the design of a cover for covering and sealing installed air conditioning units.

BACKGROUND

The following description applies to "through-the-wall" air conditioners, including packaged terminal air conditioning systems (PTACs), as they are typically installed in sleeves that are permanently in place. However, it will be noted that the description applies, with minor modifications, to window units as well; this is further explained below as the fourth embodiment of the invention.

As the name implies, through-the-wall air conditioners (ACs) are installed through a wall which is mainly a permanent installation when compared to window installed AC units. Through-the-wall installations are common in apartment buildings, hotels and other commercial institutions. These installations offer a few advantages over window installed units; these are: (1) the sleeves are permanent installations that typically outlast the life of the AC unit (2) they do not block views, light and ventilation (as needed) through the window and (3) they are, overall, more esthetically appealing. The main disadvantage of through-the-wall installations, however, is that they are difficult to seal particularly for older sleeve installations. The units are typically installed in a sheet metal sleeve that is attached to the wall of the building; over time, these sleeves could deform, corrode or otherwise prevent effective sealing around the periphery of the unit. Without proper sealing, air is exchanged with the outside and this, particularly during winter, represents significant energy losses. Furthermore, an effective cover/sealing system prevents the movement of bugs, insects, etc., through the unit into the dwelling.

There have been numerous attempts to provide effective sealing of air conditioning systems for both through-the-wall and window installations. U.S. Pat. No. 5,125,197 to Fuchs, for example, consists of a rigid cover apparatus that is mechanically clamped onto the part of the air conditioning unit that projects into the room; it further includes a member that is placed between the wall and the cover to prevent air infiltration. This system has too many parts, is rigid and would be relatively difficult to install. Another example of the prior art is U.S. Pat. No. 4,788,805 to Shaw which teaches "rotatable retainers" to secure a rigid cover against the wall; thus, the wall needs to be modified in order to mount the retainers. For an unskilled home owner, placing the rotatable retainers in the proper location around the periphery of the cover may be problematic. Yet another example is U.S. Pat. No. 9,347,217 to Feur, et al. which teaches the assembly of a number of parts in order to form a cover. U.S. Pat. No. 6,061,981 to Nieves is another example of the prior art which teaches a rigid assembly with integral sealing gaskets that lock onto the body of the air conditioning unit to prevent air infiltration. In general, the prior art is replete with one or more of the following features: rigid covers; rigid covers that must be assembled; require modifications to the wall which, in turn, may require some skill; do not seal against the wall but against the air conditioning unit, and so on. Additionally, newer air conditioner units typically include a plastic trim that slides over the unit and against the wall; the trim is intended to cover any gaps around the AC unit and the sleeve or wall while providing some protection against air infiltration. The trim is not very effective with respect to preventing cold air intrusion as it offers no real sealing capability. Finally, covers to be located or mounted on the exterior side of the air conditioning unit are not considered germane prior art.

BRIEF SUMMARY OF THE INVENTION

Given the limitations of the prior art, the primary objectives of the invention are as follows: to provide a cover or sealing solution that effectively seals the unit; that is easy to install; that is easy to remove; that is easy to clean and that is easy to store when not in use. By utilizing a flexible material with an integral fastening system that can be affixed to the wall, the invention achieves all of the aforementioned objectives.

DETAILED DESCRIPTION OF INVENTION

In the following detailed description of the invention, certain preferred embodiments are illustrated providing certain specific details of their implementation. However, it will be recognized by one skilled in the art that many other variations and modifications may be made given the disclosed principles of the invention.

Figure 1:
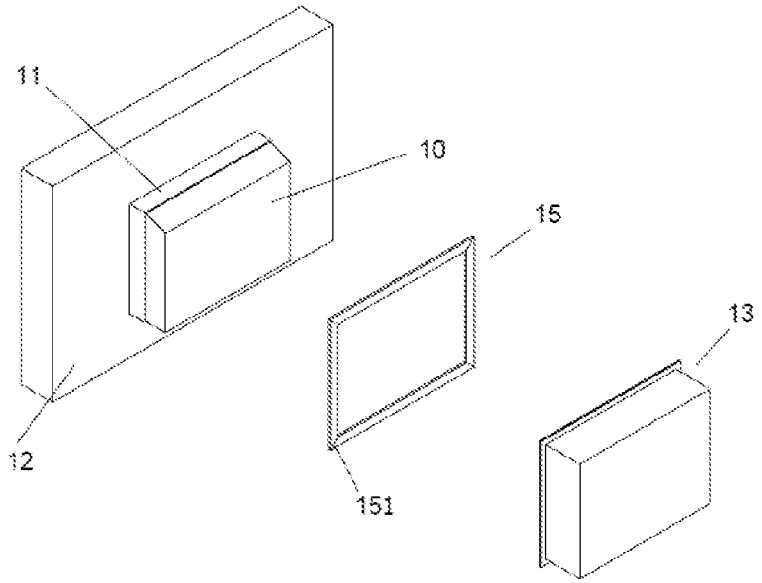
FIG. 1 is a semi-exploded view showing the main embodiment of the invention.
Figure 2:
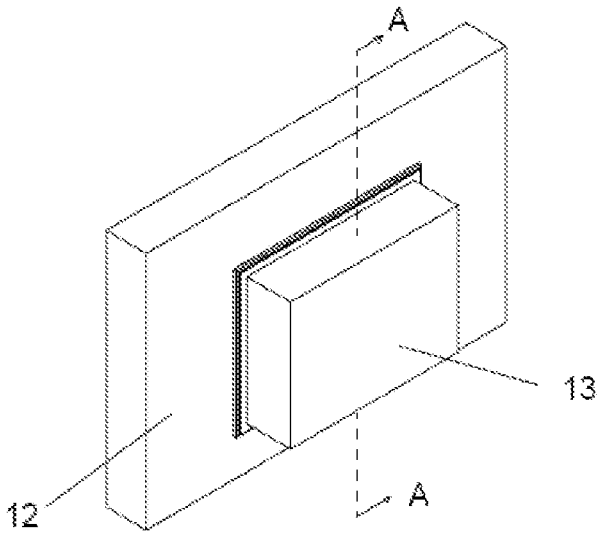
FIG. 2 shows the installed cover in the main embodiment.
Figure 3:
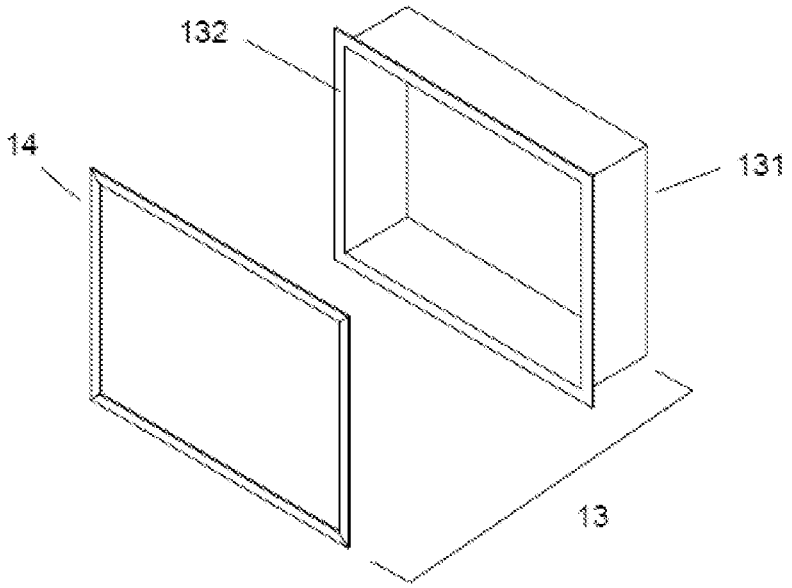
FIG. 3 depicts the elements of the cover in the main embodiment.
Figure 4A:
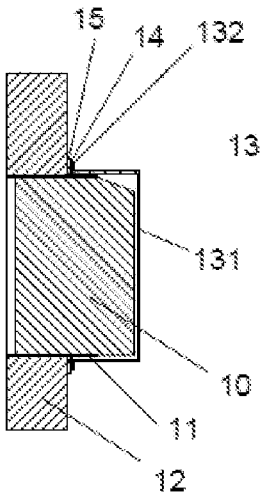
FIG. 4*a* is a cross-sectional view along line A-A of FIG. 1 and depicts the various components of the system.
Figure 4B:
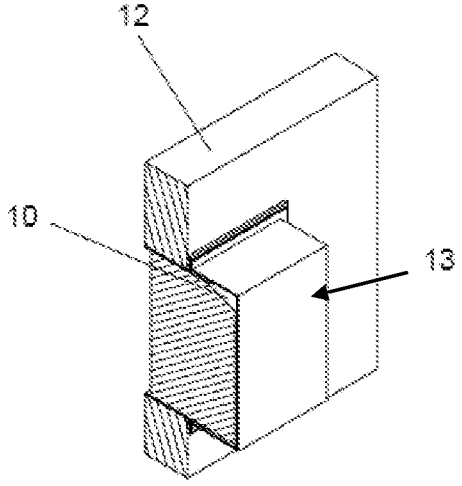
FIG. 4*b* is a three-dimensional view of the cross-section depicted in FIG. 4*a*.

As depicted in FIG. 1, a through-the-wall AC unit 10 is installed into a sleeve 11. The sleeve 11 is fixed to the wall 12 and the AC unit 10 is inserted, by sliding, into the sleeve 11. The unit 10 nominally seats in the sleeve 11 without any mechanical means of being affixed to it. Depicted in FIG. 2 is the installed AC unit 10, covered and sealed against the wall 12 by the cover 13 of the present invention. It is noted that while the cover 13 is depicted in the various figures as a rigid part, which is also a feasible implementation of the invention, it is preferably a fabric. In the main embodiment of the invention, the cover 13 is installed on the wall 12 via a hook and loop fastening system; one commercially available hook and loop type fastener is sold under the trade name Velcro. The cover 13 is stitched from a fabric to form what is essentially an open box; that is, a box with five sides. The open end of the cover 13 is sized to fit over and envelop the installed AC unit 10 and the sleeve 11; thus, the depth of the cover is sized to be at least the distance by which the AC unit 10 projects into the room. As there are various wall thicknesses, this means that the depth of the cover 13 is sized to accommodate the depth of various standard units, when installed in a sleeve 11; the worst case would be to size the depth to accommodate the maximum amount of projection into the room. Referring to FIG. 3, a flange 132 is integrally formed around the periphery of the open end of the enclosure member 131 such that the flange is perpendicular to and extends beyond the sides of the cover and is parallel to the wall, when installed. One component of a separable fastener, for example, a hook and loop fastener, the loop half 14, is stitched or otherwise mechanically secured to the flange 132; the other half of the hook and loop fastener, the hook half 15, is attached to the wall. It is noted that in the various figures, the wall mounted half of the fastening system, for example, the hook half 15, while shown as a single piece or part may be comprised of multiple, separate pieces joined at corners 151 for easier installation. FIG. 4*a* and FIG. 4*b* show the relative position and location of the various components of the system when installed and thus, sealing the AC unit 10.

The hook half 15 of the separable fastening system is preferably adhesive backed such that, by simply peeling off the adhesive cover, the user can install the hook half 15 of the fastener onto the wall. However, in the absence of the adhesive backing on hook half 15, it may be epoxied, stapled, nailed or otherwise mechanically fastened to the wall. Of the various fastening means, an epoxy or glue is preferred in that it will form a seal with any imperfections with the wall. To install the cover 13, the user simply attaches the hook half 15 onto the wall, around the periphery of the AC unit 10 and/or sleeve 11, wraps the power cable around the AC unit 10 and slide the cover 13 over the entire assembly. The user then engages the fastening elements of the separable fastener to complete installation; the result is the assembly depicted in FIG. 4*a* and FIG. 4*b*.

Alternatively, the fastening system may be a magnetic one in which the separable components are a flexible magnet that is epoxied to the flange 132 and the other a sheet metal frame that is attached to the wall by any of the aforementioned means (that is, epoxied, stapled, nailed, etc.). Note that the separable components of the fastening system may be reversed, that is, the magnet may be secured to the wall and the sheet metal to the cover. Another means of attaching the cover 13 to the wall 12 is by using a separable, open-end zipper. In this case, a half of the zipper will be attached to the enclosure member 131 at flange 132 and the other half to a separate piece of fabric mounted to the wall. In all instances noted above, a trim cover, with some or all of the cover 13 fastening component 14, may be placed on top of the wall mounted fastening component 15 to conceal it from view when the cover 13 is off.

A second embodiment of the invention is one that is better suited to prevent air exchange with the outside when the AC unit 10 is being operated; in this instance, the cover 20 is made from two distinct parts.

Figure 5:
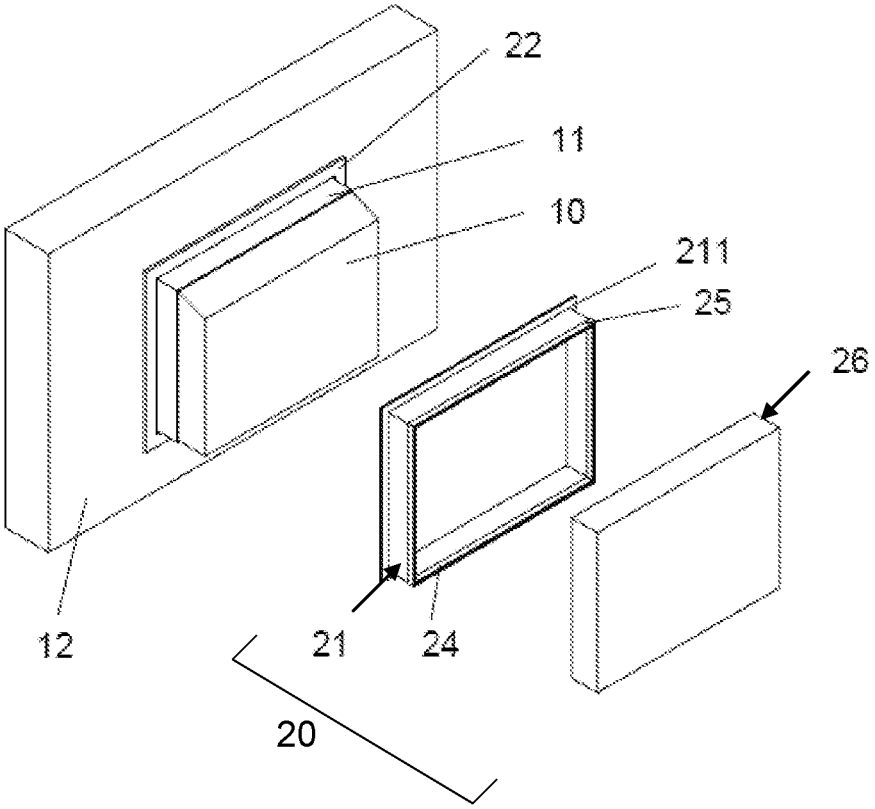
FIG. 5 shows a second embodiment of the invention.
Figure 6:
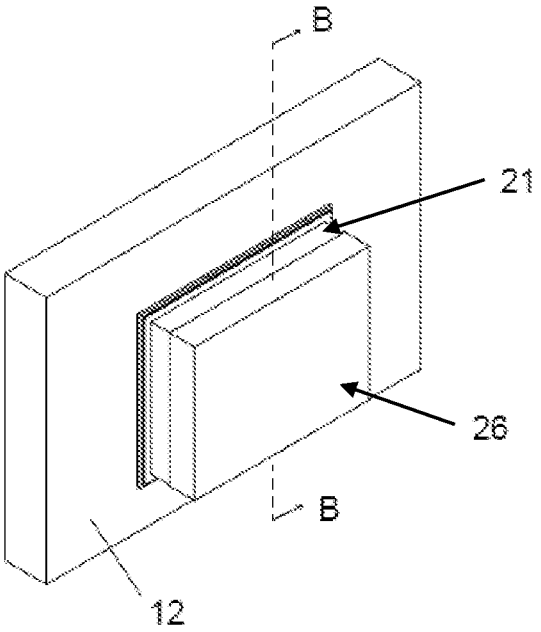
FIG. 6 is a semi-exploded view of the main components of the second embodiment.
Figure 7:
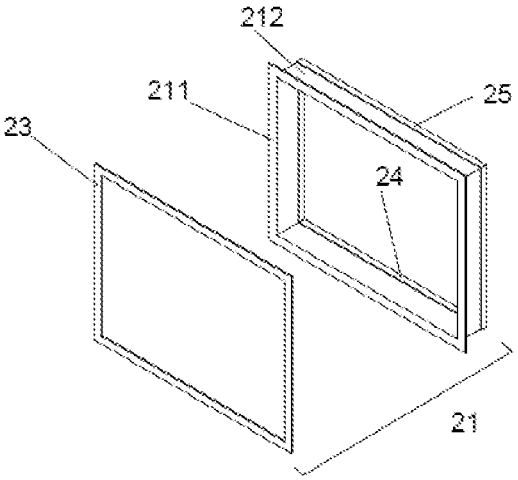
FIG. 7 depicts the components that comprise a first member of the cover according to the second embodiment.
Figure 8:
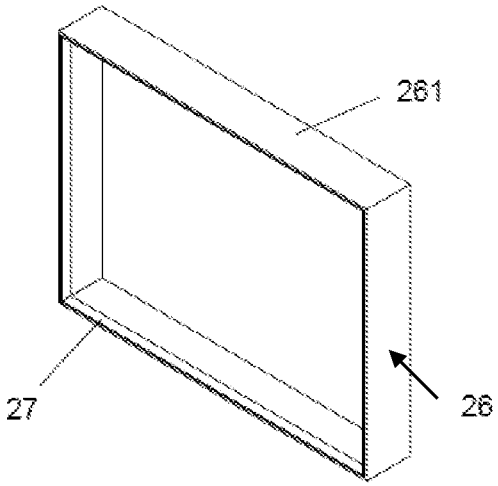
FIG. 8 depicts the components that comprise the second member of the cover according to the second embodiment.
Figure 9A:
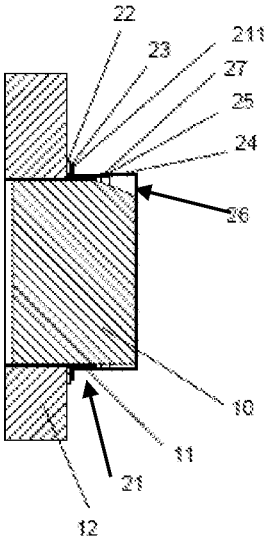
FIG. 9*a* is a cross-sectional view along line B-B of FIG. 5 and depicts the various components of the system.
Figure 9B:
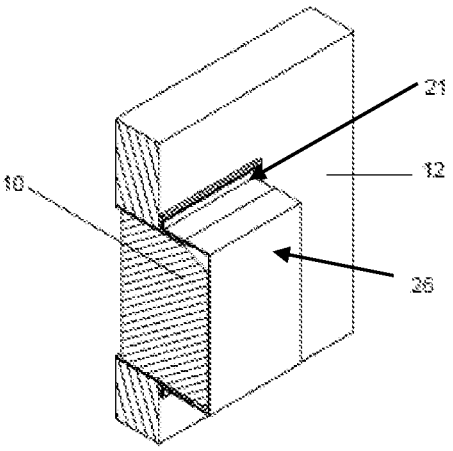
FIG. 9*b* is a three-dimensional view of the cross-section depicted in FIG. 9*a*.

Referring to FIG. 5, FIG. 6, and FIG. 7 the cover 20 is comprised of a first part, a skirt 21, that is open on both ends, and includes the flange 211 that is integrally formed on the wall end of skirt enclosure member 212. Separable fastening system component 23 is attached to the flange 211; however, fastening component 23 may not be used if the skirt 21 is to be permanently mounted to the wall by any mechanical means such as stapling, epoxying, etc. Using any of the aforementioned separable fastening means, however, will allow for complete separation of the skirt 21 from the wall 12, which will permit easy cleaning of the part. The skirt 21 has a minimum depth that is defined by the distance from the wall 12 to the point at which the AC unit 10 meets the sleeve 11. A means for tightly wrapping the open end (non-wall end) of skirt 21 around the AC unit 10 and sleeve 11 is provided in order to create a seal between these parts. This means may be an elastic band 24, sewn into the inner periphery of the non-wall open end. A bungee or elastic cord will serve the same function as elastic band 24 as would a non-elastic string that can be tightened and held in place with a barrel or cord lock; each of these elements can be retained in a channel on the inner periphery of the non-wall end of skirt 21. Referring to FIG. 8, the second part of the cover 20, in this embodiment is the back cover or enclosure member 26; it is designed to fit over the remaining, exposed, part of the AC unit 10 such that the entire device can be covered and sealed in the winter. To this end, the outer periphery of the skirt enclosure member 212, contains a means by which the inner periphery on the open end of the back cover 26 can be separably fastened. Specifically, the loop half 25 of a hook and loop fastener may be stitched onto skirt enclosure member 212 and the hook half 27 to back enclosure member 261. A zipper or flexible magnets can also be used for the same purpose; that is to close and attach skirt 21 to back cover 26. The completely assembled parts are depicted in their relative positions in the cross-sectional views of FIG. 9*a* and FIG. 9*b*.

When, in both embodiments described above, the cover 13, 20 are made from a flexible material (or fabric), these parts may be constructed so as to sandwich an insulating material between two layers of fabric. In this manner, the cover 13, 20 will also provide a secondary thermal barrier while sealing the AC unit 10.

A third embodiment of the invention relates to new installations of through-the-wall units which typically include a plastic trim provided by the manufacturer. In this instance, the wall mounted separable fastening system component may be placed under or on the trim or on the periphery around the trim, that is, on the wall. If placed under (that is, between the wall and the trim), the fastening system component will be concealed from view when the cover 13, 20 is off the unit; however, this means that to install the cover 13, 20, the trim will have to be removed. The preferred option here is to place the fastening system component around the periphery of the trim and on the wall such that the trim is also sealed and covered.

A fourth embodiment of the invention relates, specifically, to window installed air-conditioners. For these installations, the wall mounted separable fastening system component, as described above, will instead be mounted to the window's frame (fixed and movable). In general, the design and construction of the cover will be similar to both types of covers described above, that is, it will have a flanged section that is attachable and detachable from the fastening half that is attached to the window frame. A trim cover, with some or all of the cover fastening half, may be placed on top of the window frame mounted fastening half to conceal it from view when the cover is off.

The foregoing description is for the construction of a cover or sealing system for a through-the-wall installed AC unit. Clearly, there are alternate embodiments of the described features that can be implemented to achieve the same outcome; that is sealing the unit against air exchange with the outside. It is understood that many modifications and variations may be devised given the above description of the principles of the invention. It is intended that all such modifications and variations be considered as within the spirit and scope of this invention.

The invention claimed is:

1. An improved cover for an air conditioner comprising: two flexible enclosure members that are joined together to form a seal around said air conditioner with the first flexible enclosure member being open on both the wall and non-wall ends and the second enclosure member being open on one end and closed on the other, wherein the first flexible enclosure member has a flange integrally formed along tie periphery of its wall end such that said flange forms a plane parallel to the surface within which the air conditioner is installed, said flange has affixed to it a separable element of a fastening system, and the opposite element of said fastening system being affixed to the surface through which the air conditioner projects such that mating or joining the fastening-system elements forms a complete cover and seal around the air conditioner.

2. The cover of claim 1, wherein the first flexible enclosure member projects from the wall a distance nominally larger than the distance the air conditioner sleeve projects from the wall.

3. The cover of claim 1, wherein the first flexible enclosure member has affixed to the inner periphery of its non-wall end a flexible element that can be used to tightly draw the edge around the air conditioner unit.

4. The cover of claim 1, wherein the first flexible enclosure member has affixed to the outer periphery of its non-wall end, one element of a fastening system and the second enclosure member has affixed to its periphery at the open end, the opposite element of the fastening system such that by mating or joining the two fastener elements, the cover seals the entire air conditioner.

5. The cover of claim 4, wherein the fastening system is a hook and loop fastener.

6. The cover according to claim 4, wherein the fastening system is an open-end zipper.

7. The cover according to claim 1, wherein the surface is a window frame.

* * * * *